US005611608A

United States Patent [19]

Clausen

[11] Patent Number: 5,611,608

[45] Date of Patent: Mar. 18, 1997

[54] COMPUTER-OFFICE DESK

[76] Inventor: Mark Clausen, R.R. 2, Box 196, Wild Rose, Wis. 54984

[21] Appl. No.: 327,430

[22] Filed: Oct. 21, 1994

Related U.S. Application Data

[63] Continuation-in-part of Ser. No. 957,995, Oct. 6, 1992, abandoned.

[51] Int. Cl.[6] ..... A47B 81/00

[52] U.S. Cl. ..... 312/223.3; 312/194; 108/76; 108/138; 248/284.1; 248/918

[58] Field of Search ..... 312/194, 196, 312/223.3, 290, 315, 319.3, 326, 327, 23, 26; 108/76, 138; 248/276.1, 284.1, 299, 918

[56] References Cited

U.S. PATENT DOCUMENTS

| | | | |
|---|---|---|---|
| 2,164,133 | 6/1939 | Efron | 312/290 X |
| 2,170,098 | 8/1939 | Stephenson | 312/319.3 X |
| 5,101,736 | 4/1992 | Bommarito et al. | 312/194 X |
| 5,403,082 | 4/1995 | Kramer | 312/223.3 X |

FOREIGN PATENT DOCUMENTS

| | | | |
|---|---|---|---|
| 802834 | 2/1951 | Germany | 312/196 |

*Primary Examiner*—Brian K. Green

[57] ABSTRACT

An office desk that can be used for traditional tasks and yet provides concealment for, yet readily available access to, computer equipment. The desk top consists of a fixed section, a separable section, and a covering section. The separable and covering sections cover an equipment compartment which contains the computer equipment. The equipment compartment is located toward either the right or left side of the desk. The separable section is located along the frontal edge of the desk top and can be opened to expose the front part of the concealed computer equipment. When in the open position, the separable section provides a working surface which forms an "L" shape with the desk top and which is capable of supporting a keyboard. The working surface is adjustable in height. The covering section is removed when computer equipment housed in the equipment compartment must be installed or replaced. An adjustable height shelf is used to position the computer equipment within the compartment so that parts requiring operator action are easily accessible from the front of the equipment compartment when the separable section is in the open position. When the covering section is in place and separable section is closed, the entire desk top is available for traditional tasks.

14 Claims, 11 Drawing Sheets

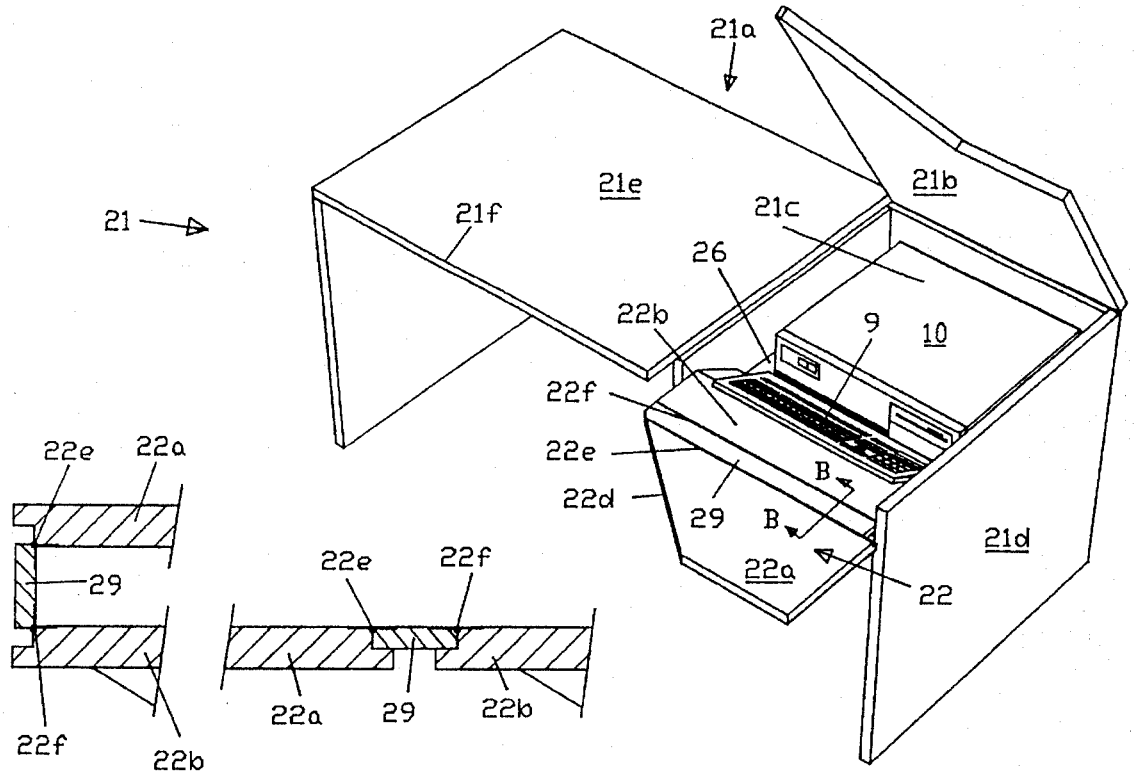
FIG. 22
FIG. 23
FIG. 24
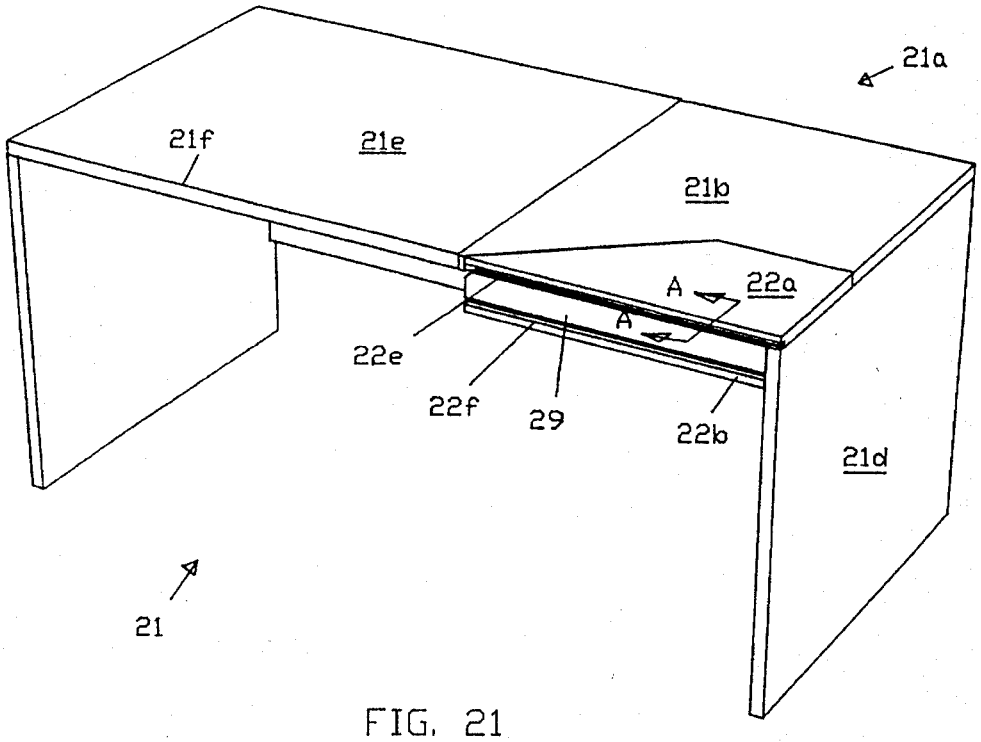
FIG. 21

COMPUTER-OFFICE DESK

This is a Continuation-in-Part of Serial Number 957,995, Filed 1992 Oct. 6, now abandoned.

BACKGROUND—FIELD OF INVENTION

The invention relates to a desk which can accommodate personal or microcomputers and their associated equipment.

BACKGROUND—DESCRIPTION OF PRIOR ART

There has been a tremendous growth in the number of personal and microcomputers in use over the last few years. Computer prices have decreased and the amount of software has increased making the personal computer available and useful to more office workers. The computer is now used by many workers in connection with their other activities and is no longer reserved for use by data entry operators and data processing professionals. However, many workers still spend a large part of their time using their desks for traditional tasks as writing, reading, and assembling reference materials. Therefore it is important to incorporate computer equipment into a desk in a way that, when the computer is not being used, will not interfere with the desktop surface used for traditional tasks. This incorporation should also be done in a way that will not use additional floor space. Further, the computer should be enclosed to be protected from access by unauthorized users and from dust and dirt.

It is also desirable to use the computer equipment in connection with traditional tasks. One might assemble reference materials, prepare a written outline, and then use a computer word processor to write a document during which the outline might have to be modified and reference materials used repeatedly. Therefore, the computer equipment should be available from the desk top. Also the process of bringing the computer equipment into operation should not require that a large part of the desk top be cleared or a large amount of effort expended.

Still further, it is desirable to incorporate the computer equipment in a ergonomically correct way that will be comfortable and healthy for the user. Damage to the wrist and hands is now the fastest growing category of worker's compensation claims and has been estimated to cost billions of dollars a year in lost wages and medical claims. The primary reason for this growth is the increased use of computer keyboards. One of the ways to avoid injury is to adjust keyboard height and/or angle to fit the individual user. It is also recommended that a leg-room clearance envelope be provided under the operating edge of the keyboard worksurface. A clearance envelope is specified as not only height but also width and depth, measured with respect to the center of the operating edge of the keyboard worksurface. The recommended range of keyboard worksurface heights and under the worksurface clearance envelopes is shown in ANSI/HFS Standard 100-1988 also titled *The American National Standard for Human Factors Engineering of Visual Display Terminal Workstations.*

Several patents show computer equipment stored within a desk. U.S. Pat. Nos. 4,669,789 of P.F. Pemberton (1987), 5,071,204 of Price et al. (1991), and 4,735,466 of Wolters et al. (1988) all show desks that have computer equipment stored in ways that do not use desktop space. However, for each desk, when the computer equipment is in use, either some or all of the desktop space that could be used for traditional tasks, such as writing, is extremely limited, made inaccessible, or not at a comfortable height. In addition, before such desks can be converted into computer workstations, the working materials on the surface of the desks must be cleared away from the main work area which is time consuming and inconvenient if these are the very materials to be used in connection with the computer work. Furthermore, the prior art desks do not provide simultaneously two working surfaces at two different levels, one comfortable for writing and one comfortable for keyboard use. In addition they do not provide two working surfaces with operating edges that form an angular or "L" shape so that the operator can easily turn from one surface to the other. Also, there are no means for adjusting the height of the surface used for a keyboard to provide ergonomic operation for users of different dimensions.

Other desks as in U.S. Pat. Nos. 4,345,803 of Heck (1982) and 1,827,128 of Wege (1931) show desks with two different height working surfaces with operating edges which are angularly connected. Neither, however, has enclosed compartments for storage of computer equipment or an adjustable height keyboard shelf. Also their angular shapes use additional office floor space even when the lower level surfaces are not being used.

U.S. Pat. No. 2,533,155 of Hacht (1950) shows an adjustable height shelf that forms an angular surface with the main desk top. However, aside from the adjustable height shelf, it has the same deficiencies as Heck and Wege. Furthermore, because the shelf was not intended for keyboard use, no provisions were made for an adequate under shelf leg-room clearance envelope.

U.S. Pat. No. 2,743,145 of Edwards (1956) shows a table with fold-out sections that when open provide a lower level working surface and when closed form a higher working surface. However, the table was not designed for use as a desk or a computer workstation. Therefore, no provisions have been made for the storage of computer equipment of different sizes that could be used in conjunction with the opened lower working surface. Also, the lower surface is not at a comfortable height for keyboard use and is not adjustable in height. Because the table was not intended for use as a desk, no under surface leg-room clearance envelope is provided for the upper surface. Also, the leg-room clearance envelope of the lower surface is such that its only operating edge is parallel to and at a considerable distance from the upper surface. This makes it impossible to use the two surfaces in the same manner as one could use two surfaces with operating edges that form an angular or "L" shape.

OBJECTS AND ADVANTAGES

It is desired that the computer equipment be situated within the normal desk environment without using large amounts of desktop space or unnecessarily occupying extra floor space. Accordingly, it is an object of the present invention to provide a desk that serves the traditional functions of a desk and, at the same time, provides for housing of the computer equipment. In addition, several objects and advantages of the present invention are as follow:

To conceal the computer equipment within the desk while at the same time providing a readily available convenient access when the operator of the equipment so desires.

A further object is, to provide a desk that has a convenient and ergonomic worksurface for operating a keyboard related to the computer equipment.

A further object is, to provide a desk that has a worksurface that is adjustable in height for operating a keyboard related to the computer equipment.

A further object is, to provide a desk that has an adjustable stop mechanism so the keyboard shelf, when opened, will always return to the same height.

A further object is, to provide a desk with two different height working surfaces with operating edges which form an angular or "L" shape so that the operator can easily turn from one surface to the other.

A further object is, to provide a desk with a keyboard shelf and shelf support which maximizes under shelf leg-room clearance with respect to the operating edge of the keyboard shelf.

A further object is, to provide a desk with a keyboard shelf that only uses extra floor space when opened for use.

A further object is, to provide a desk that leaves the central desk top for traditional tasks even when the keyboard shelf is open and the computer equipment is exposed for use.

A further object is, to provide a desk that has a keyboard shelf and equipment storage compartment that do not interfere with the under surface leg-room clearance envelope of the central part of the desk.

A further object is, to provide a desk with an adjustable height shelf for positioning the computer equipment within the equipment compartment permitting easy access to controls and equipment.

A further object is, to provide a desk with a tiltable or removable covering section which when closed is the part of the desk top and conceals the computer equipment and when open permits easy access to the concealed compartment for installation and removal of the computer equipment.

A further object is, to provide a desk with an equipment compartment that when closed can protect the equipment from unauthorized access and dust.

Still further objects and advantages will become apparent from a consideration of the ensuing description and drawings.

DRAWING FIGURES

Figure 2:
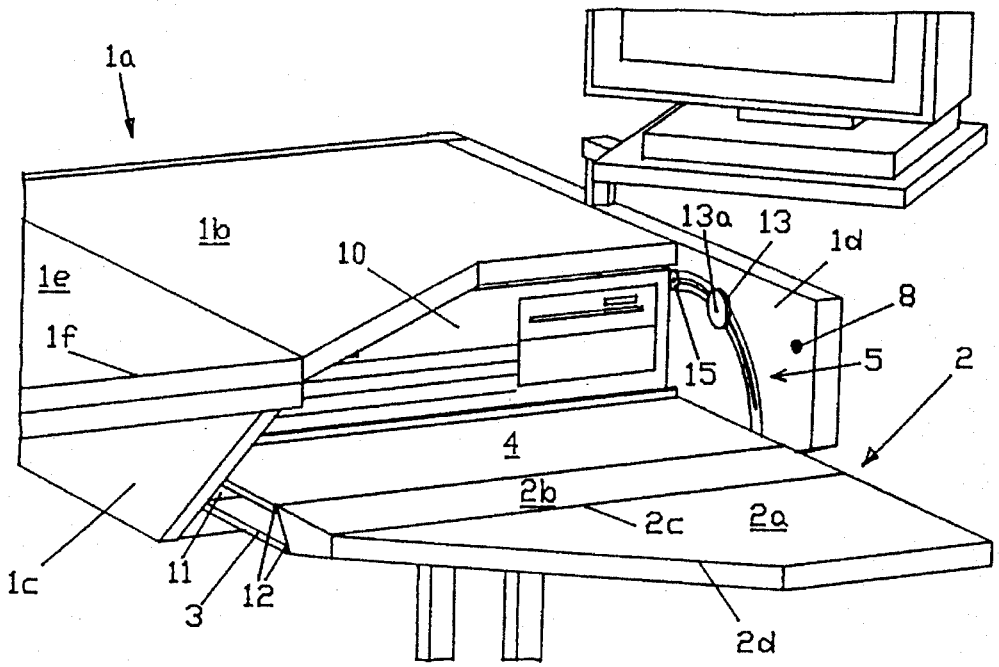
FIG. 2 shows the desk of FIG. 1 with the separable section in its open position thus forming a working surface.
Figure 2A:
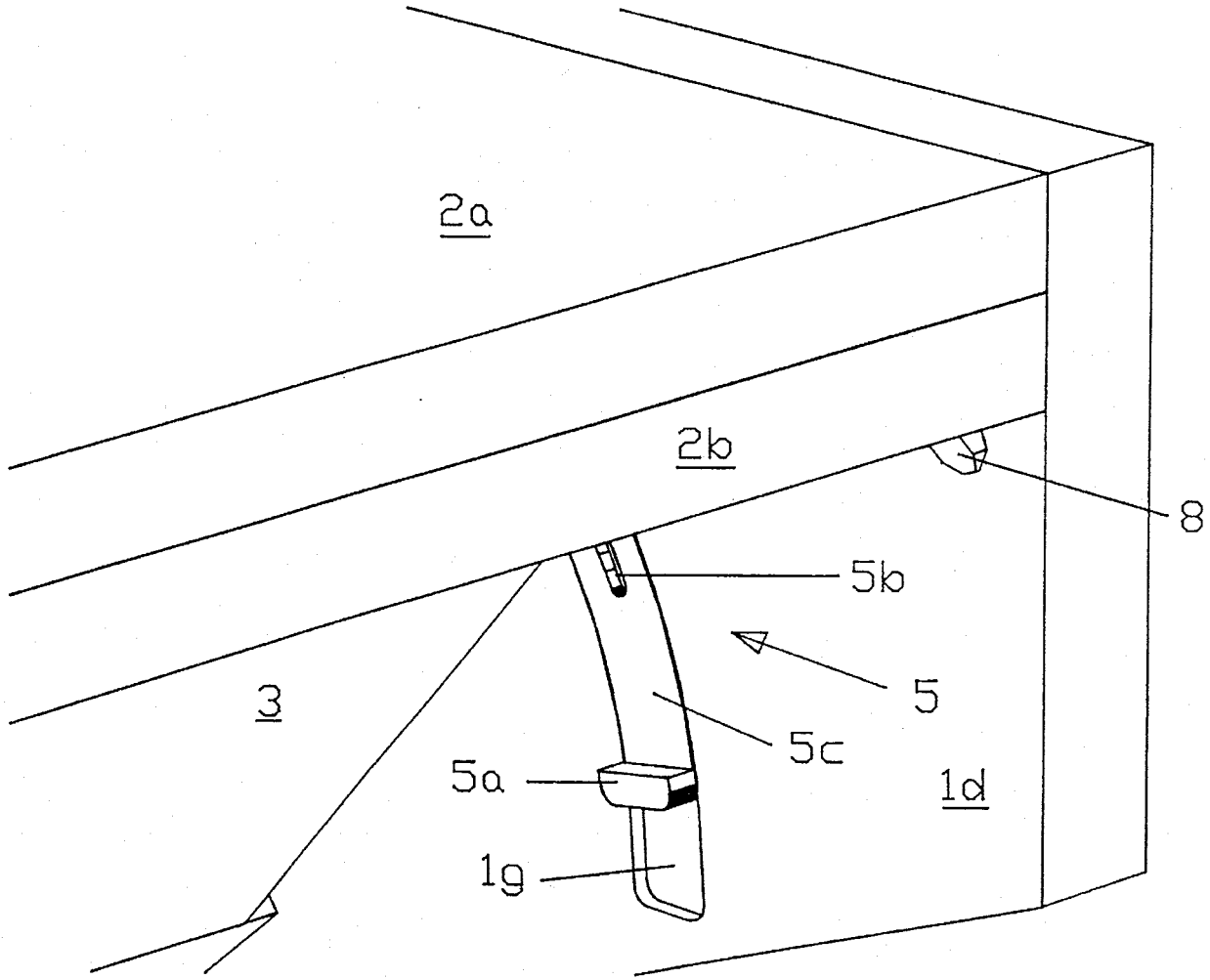

FIG. 2*a* is an enlarged perspective view of the right front corner of the desk with an adjustable stop set to an intermediate position.

Figure 1:
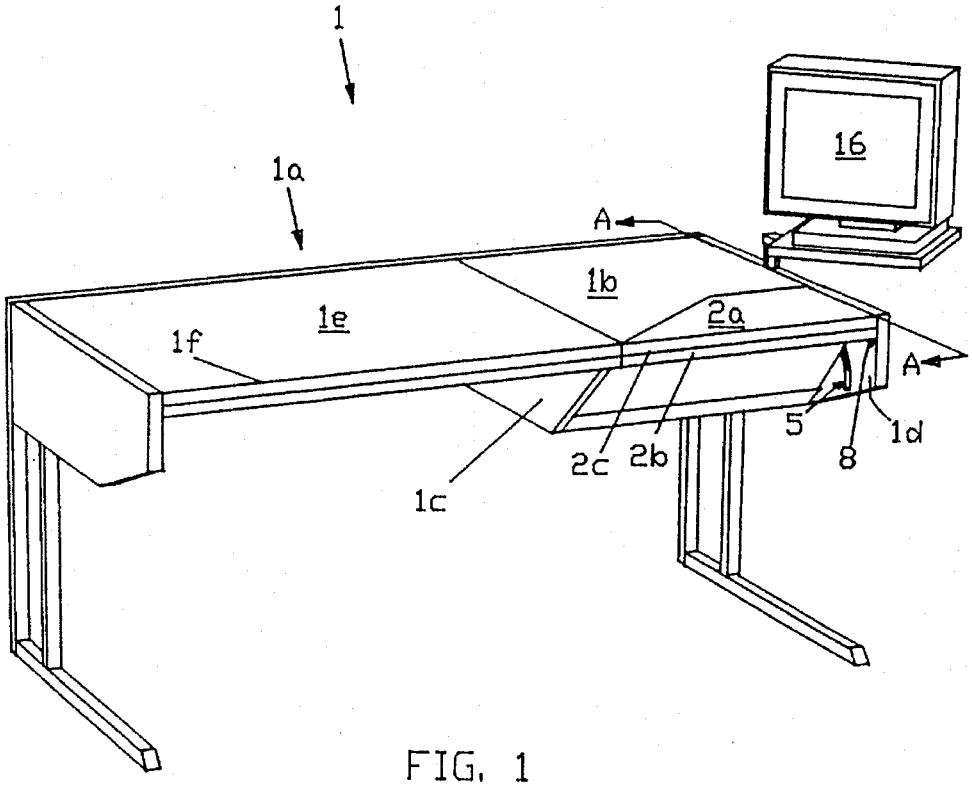
FIG. 1 is a perspective view of the preferred embodiment of the desk showing a horizontal piece in its latched position, a separable section in its closed position, an equipment compartment covering section in its covering position, and showing a computer monitor shelf and monitor.
Figure 3:
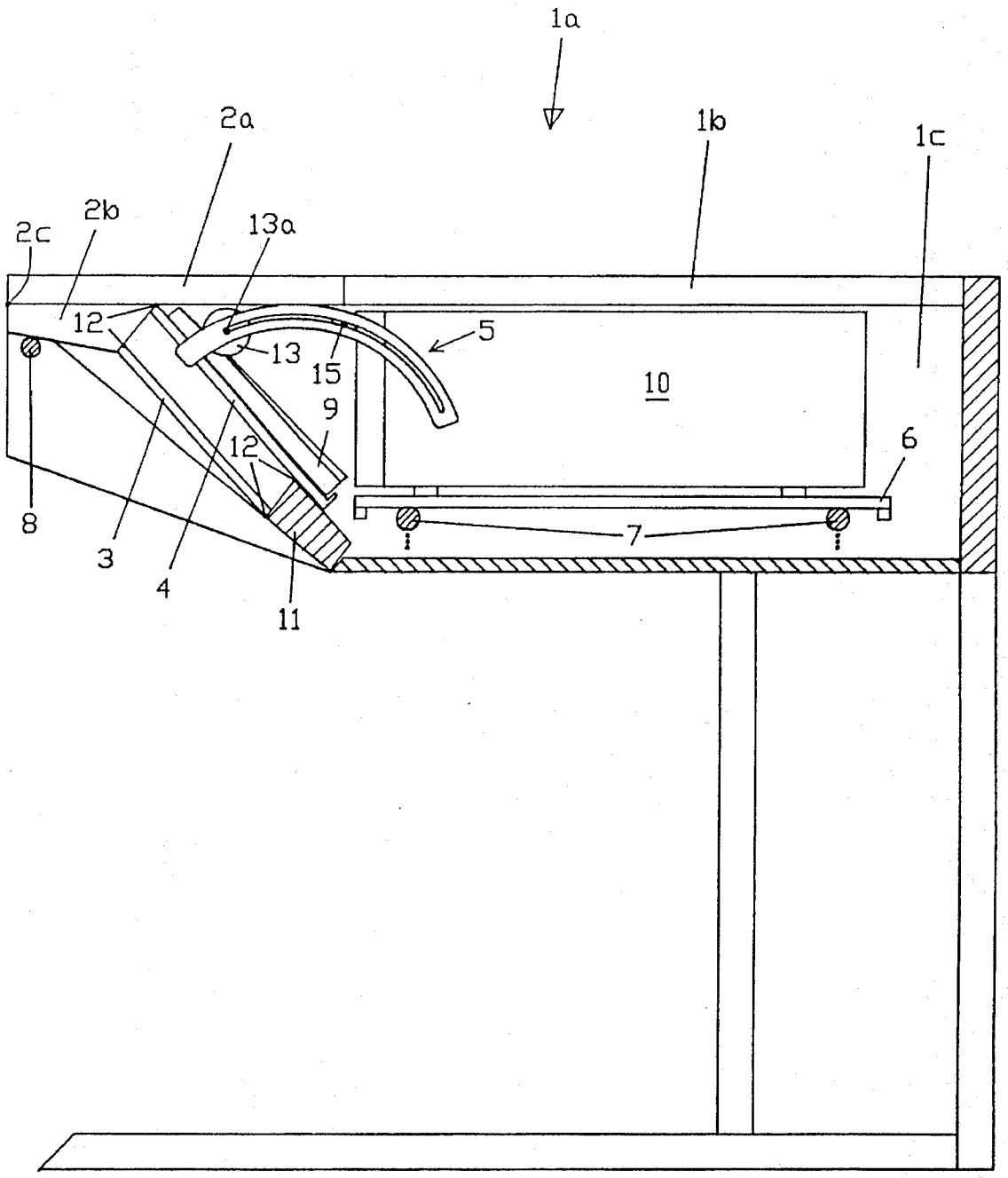

FIG. 3 is a sectional view of FIG. 1 taken along line A—A which additionally shows the adjustable stop in its uppermost position.

Figure 4:
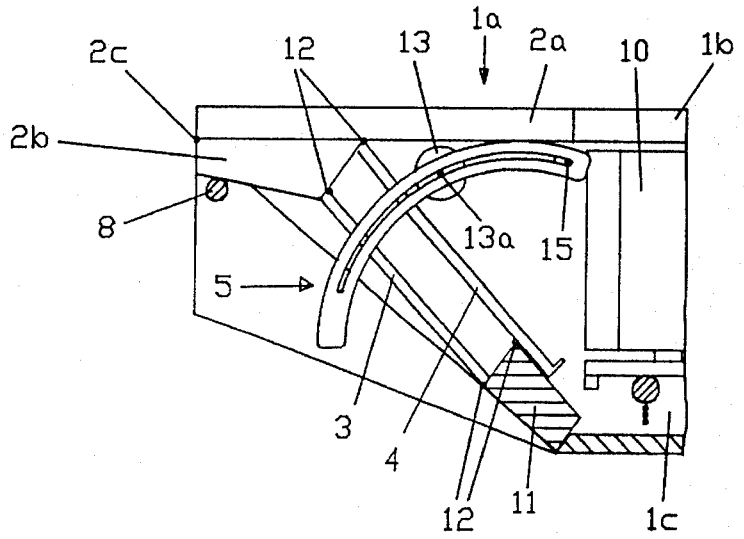

FIG. 4 is an enlarged sectional view of the elements of FIG. 3 in which the adjustable stop is shown in its lowermost position, the horizontal piece in its latched position, and the separable section in its closed position.

Figure 5:
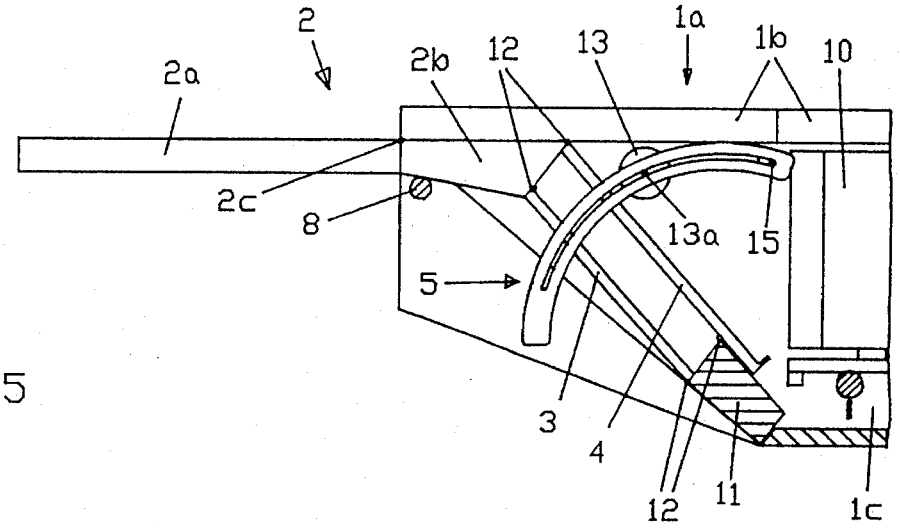

FIG. 5 is an enlarged sectional view of the elements of FIG. 3 showing the adjustable stop in its lowermost position, the horizontal piece in its latched position, and having the separable section in its open position forming a working surface.

Figure 6:
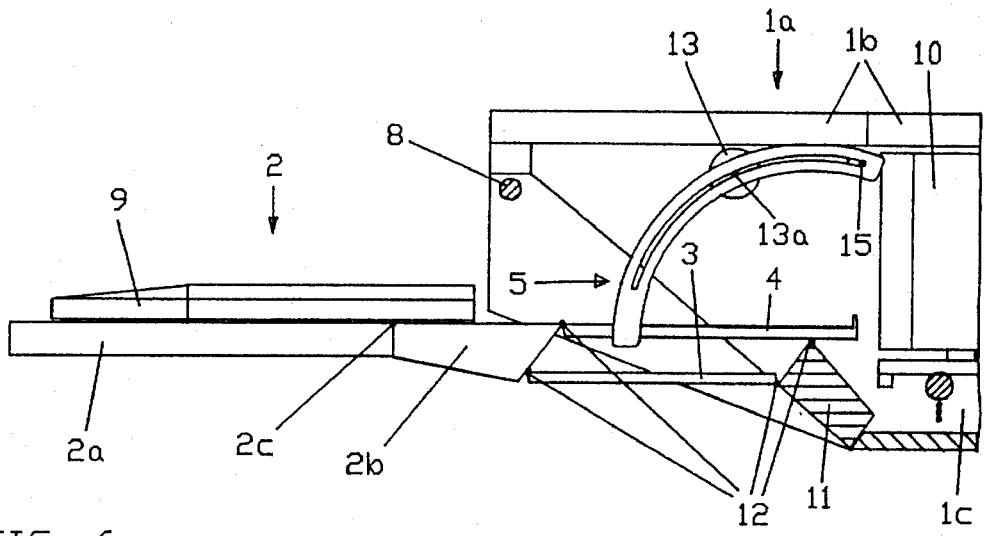

FIG. 6 is the enlarged sectional view of the elements of FIG. 3 in which the working surface is at a lower operating height determined by the adjustable stop.

Figure 7:
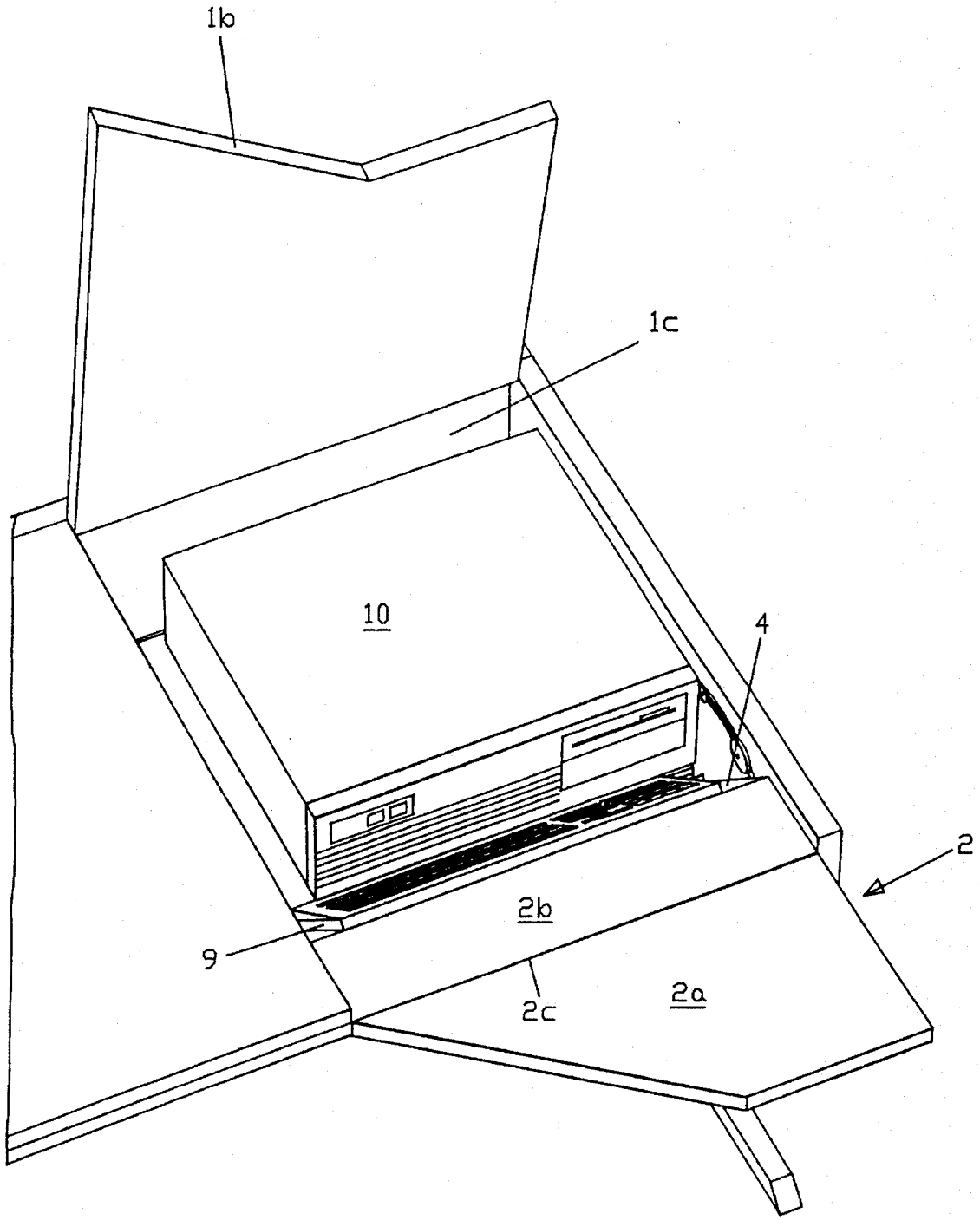

FIG. 7 is an enlarged perspective view similar to FIG. 2 but showing the covering section in its removed position and the separable section in its open position.

Figure 8:
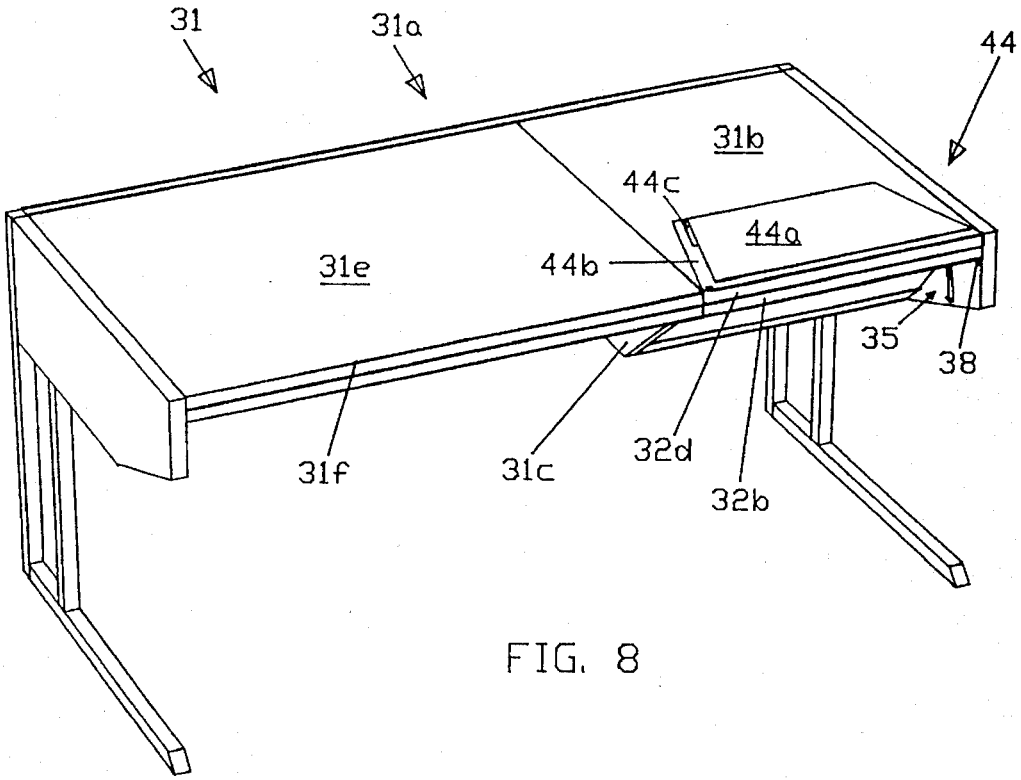

FIG. 8 is a perspective view of the second embodiment of the desk.

Figure 9:
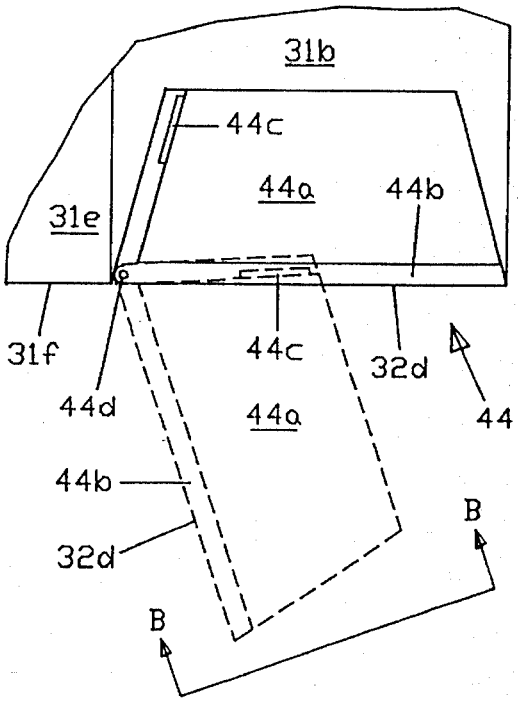

FIG. 9 is an enlarged top view of a portion of FIG. 8 illustrating a modified separable section in its closed position (in solid lines) and in its open position (in dashed lines).

Figure 10:
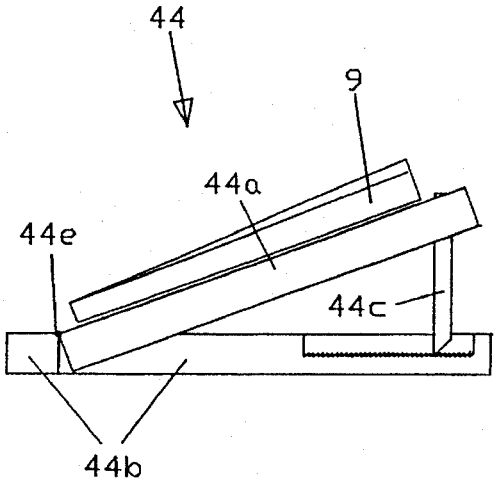

FIG. 10 is an end view of the modified shelf taken along line B—B showing a tiltable component in its highest tilted position with respect to a horizontal component.

Figure 11:
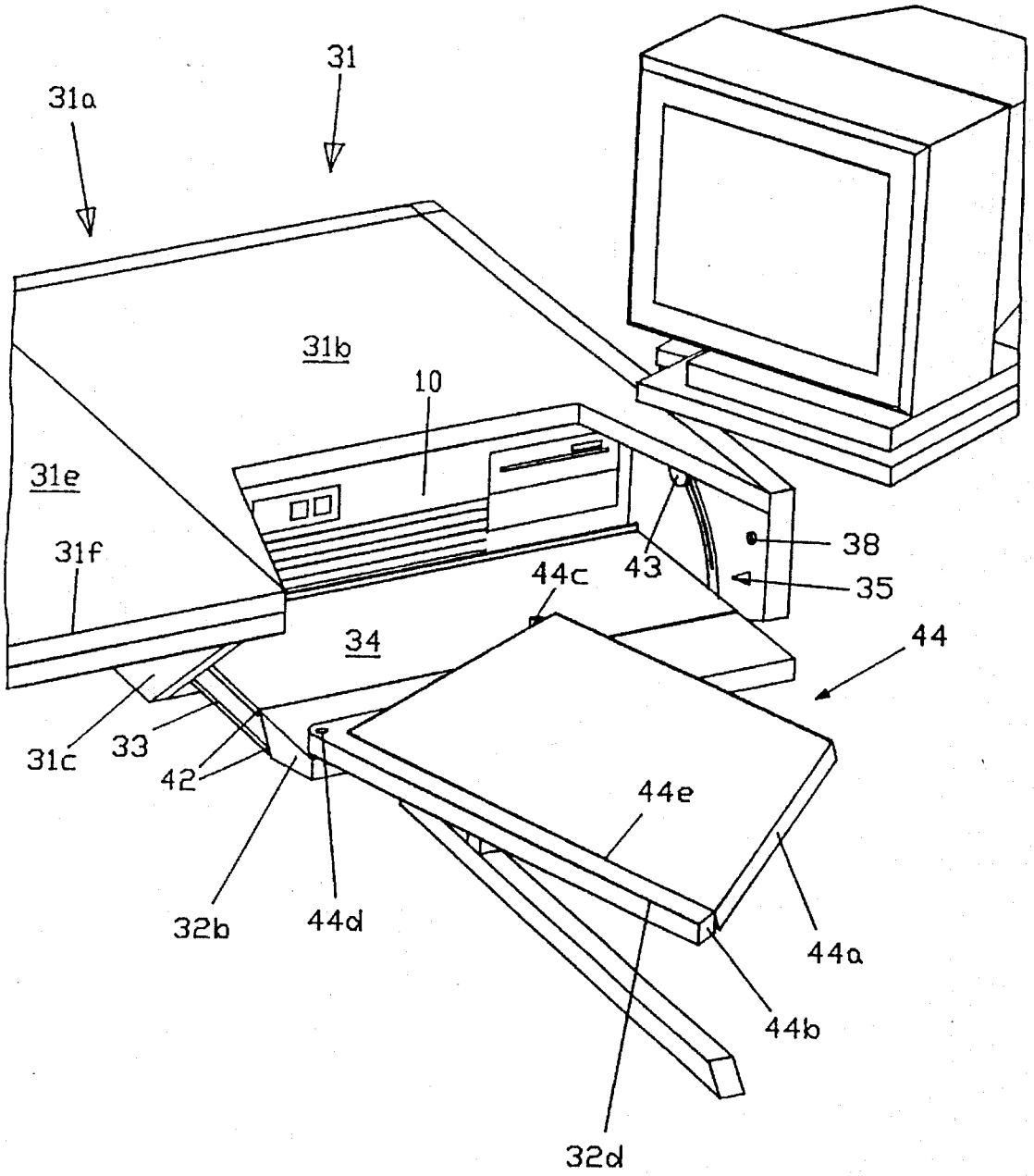

FIG. 11 is another enlarged perspective view of a portion of the second embodiment.

Figure 12:
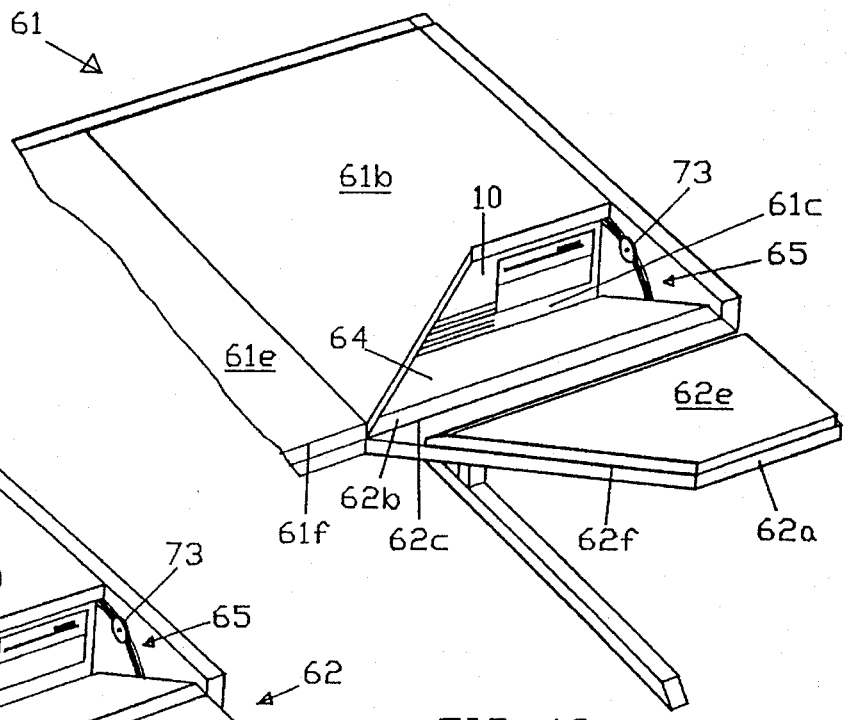

FIG. 12 is a partial perspective view of a third embodiment of the desk showing an extension shelf attached to the separable section and in its closed position.

Figure 13:
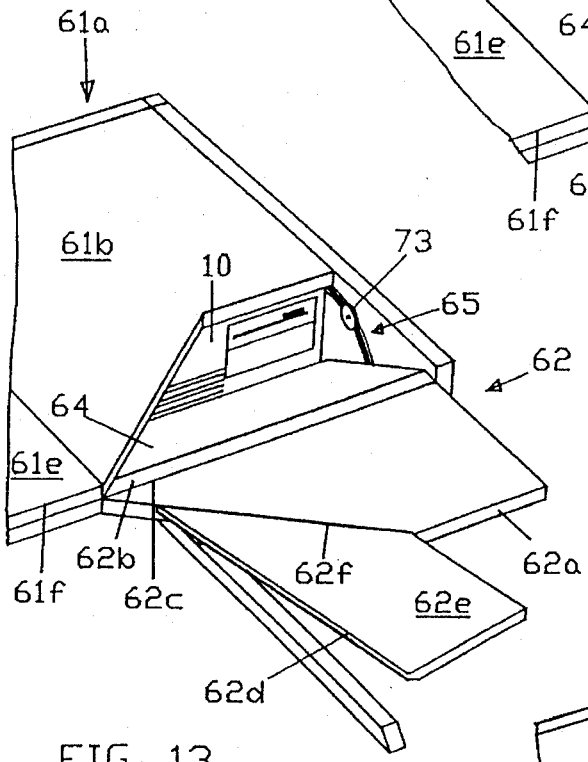

FIG. 13 is also a partial perspective view of the third embodiment showing the extension shelf in its open position thus forming an extended working surface.

Figure 14:
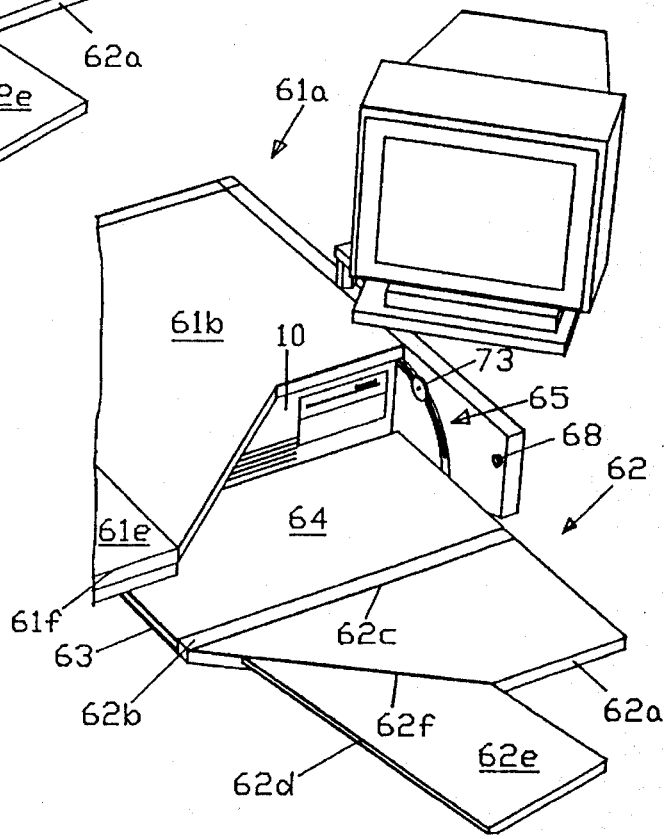

FIG. 14 is a partial perspective view of the third embodiment showing the extended working surface at an operating height.

Figure 15:
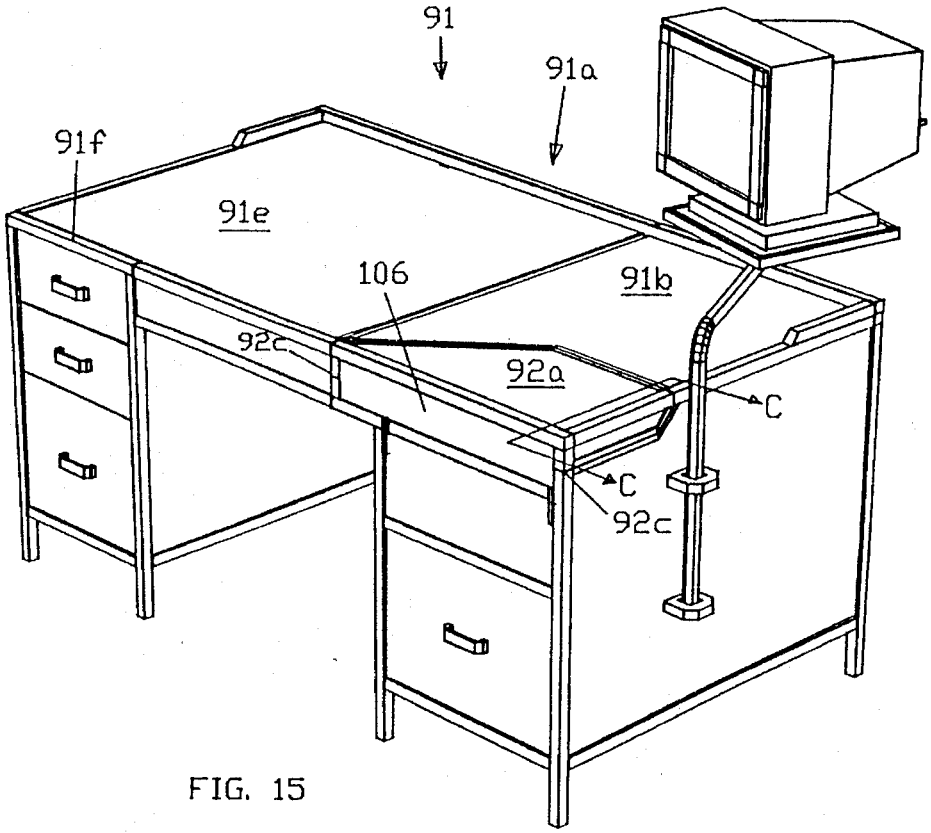

FIG. 15 is a perspective view of a fourth embodiment of the desk showing a separable section and an equipment compartment covering section in their closed and covering positions and showing a computer monitor shelf and monitor.

Figure 16:
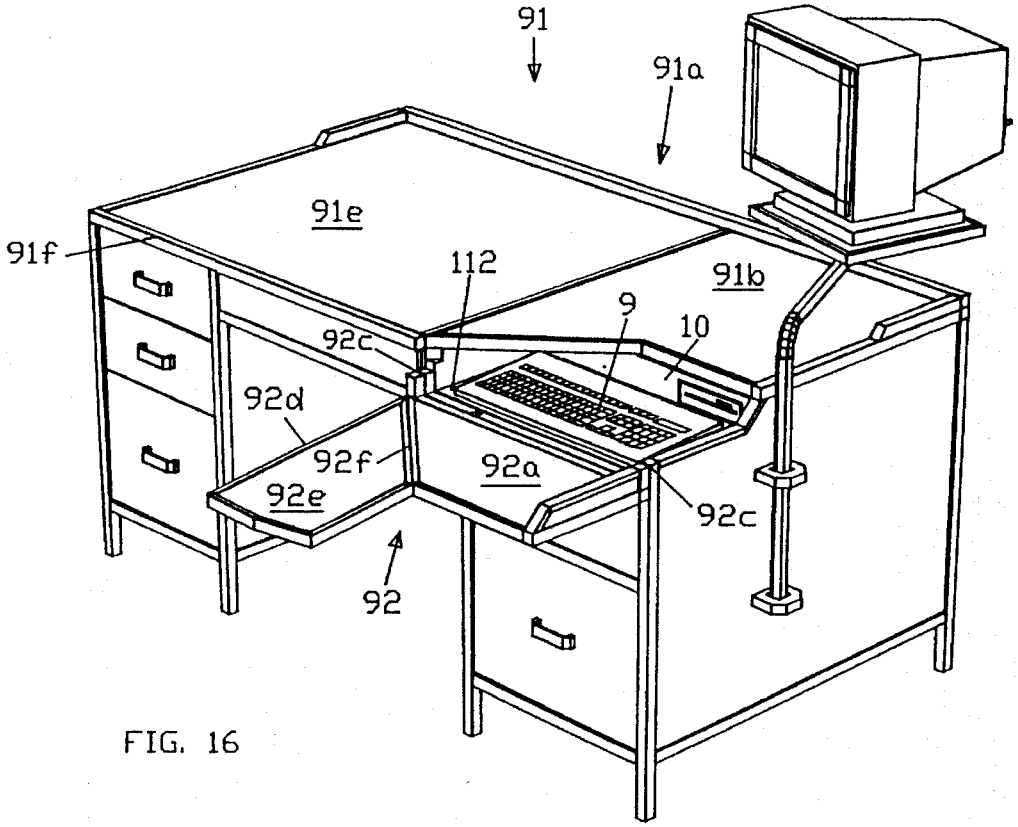
Figure 17:
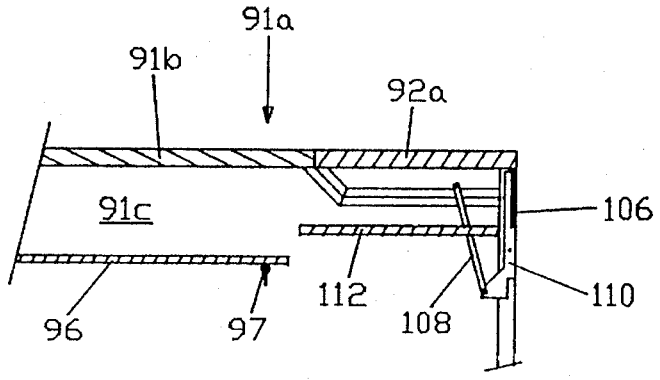

FIG. 16 shows the fourth embodiment with both the separable section and an extension shelf in their open positions thus forming an extended working surface, FIG. 17 is an enlarged sectional view of FIG. 15 taken along line C—C showing the separable section and a front panel in their closed and vertical positions respectively.

Figure 18:
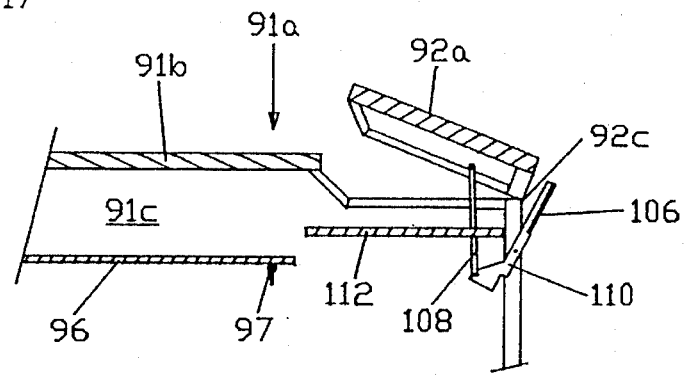
Figure 19:
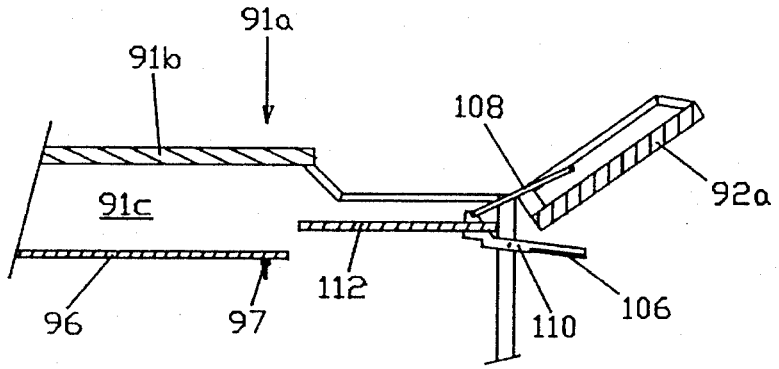

FIG. 18 and FIG. 19 are enlarged sectional views of FIG. 15 taken along line C—C showing the separable section and the front panel in their partially open positions.

Figure 20:
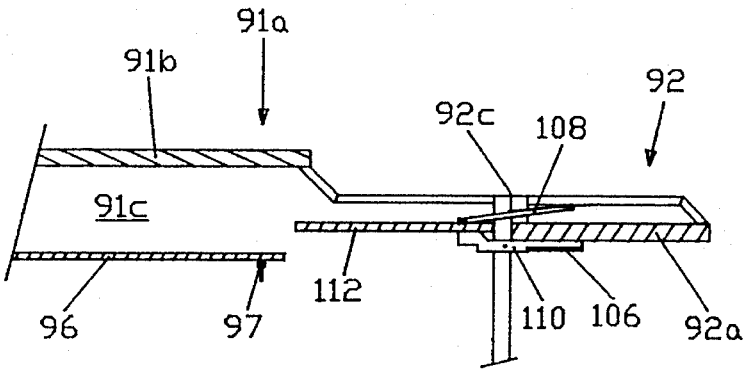

FIG. 20 is an enlarged sectional view of FIG. 15 taken along line C—C showing the separable section and the front panel in their open and horizontal positions with the separable section and a fixed shelf forming the working surface.

FIG. 21 is a perspective view of a fifth embodiment of the desk.

FIG. 22 is a perspective view of the desk of FIG. 21 with a separable section in its open positions,and an equipment compartment cover in its removed position.

FIG. 23 is a sectional view of FIG. 21 taken along line A—A where non-essential parts have been omitted.

FIG. 24 is a sectional view of FIG. 22 taken along line B—B where non-essential parts have been omitted.

Reference Numerals in Drawings

| | | | |
|---|---|---|---|
| 1 | computer-office desk | 5 | adjustable stop |
| 1a | desk top | 5a | stop protrusion |
| 1b | covering section | 5b | stop guide slot |
| 1c | equipment compartment | 5c | stop arc piece |
| 1d | side | 6 | computer shelf |
| 1e | fixed section | 7 | adjustable support |
| 1f | frontal edge | 8 | latch |
| 1g | side recess | 9 | keyboard |
| 2 | working surface | 10 | computer equipment |
| 2a | separable section | 11 | cross-brace |
| 2b | horizontal piece | 12 | levelling hinges |
| 2c | hinge | 13 | tightening knob |
| 2d | operating edge | 13a | hanger bolt |

-continued

| Reference Numerals in Drawings | | | |
|---|---|---|---|
| 3 | levelling piece | 15 | guide |
| 4 | support piece | 16 | computer monitor |
| 21 | computer-office desk | 22b | horizontal piece |
| 21a | desk top | 22a | separable section |
| 21b | covering section | 22d | operating edge |
| 21c | equipment compartment | 22e | upper hinge |
| 21e | fixed section | 22f | lower hinge |
| 21f | frontal edge | 26 | computer shelf |
| 22 | working surface | 29 | front panel |
| 31 | computer-office desk | 35 | adjustable stop |
| 31a | desk top | 38 | latch |
| 31b | covering section | 42 | levelling hinges |
| 31c | equipment compartment | 43 | tightening knob |
| 31e | fixed section | 44 | separable section |
| 31f | frontal edge | 44a | tiltable component |
| 32b | horizontal piece | 44b | horizontal component |
| 32d | operating edge | 44c | slope adjustment piece |
| 33 | levelling piece | 44d | angular adjustment hinge |
| 34 | support piece | 44e | slope adjustment hinge |
| 61 | computer-office desk | 62c | hinge |
| 61a | desk top | 62d | operating edge |
| 61b | covering section | 62e | extension shelf |
| 61c | equipment compartment | 62f | extension hinge |
| 61e | fixed section | 63 | levelling piece |
| 61f | frontal edge | 64 | support piece |
| 62 | working surface | 65 | adjustable stop |
| 62a | separable section | 68 | latch |
| 62b | horizontal piece | 73 | tightening knob |
| 91 | computer-office desk | 92d | operating edge |
| 91a | desk top | 92e | extension shelf |
| 91b | covering section | 92f | extension hinge |
| 91c | equipment compartment | 96 | computer shelf |
| 91e | fixed section | 97 | adjustable support |
| 91f | frontal edge | 106 | front panel |
| 92 | working surface | 108 | connecting rod |
| 92a | separable section | 110 | pivotal member |
| 92c | hinge | 112 | fixed shelf |

Description—FIGS. 1 to 20

Referring now to FIGS. 1 through 7 wherein computer-office desk 1 is the preferred embodiment of the invention. In the figures like reference characters represent like parts throughout the views.

FIG. 1 shows that desk 1 has a normal desk top 1*a* where desk top 1*a* has a frontal edge 1*f* and where desk top 1*a* comprises a fixed section 1*e*, a covering section 1*b*, and a separable section 2*a* where the top surfaces of all sections are co-planar. Covering section 1*b* and separable section 2*a*, providing concealment for computer equipment housed in an equipment compartment 1*c*, are shown in their covering and closed positions. FIG. 1 shows that when computer equipment is not in use the full desk top 1*a* of desk 1 is available for traditional tasks. It also shows that there are no parts or structures that interfere with the leg-room clearance envelope under the central portion of desk top 1*a*. FIG. 1 further shows a side 1*d*, a horizontal piece 2*b*, a hinge 2*c*, an adjustable stop 5, and a latch 8. Latch 8 is a spring loaded cylinder arranged on side 1*d* so that horizontal piece 2*b* and separable section 2*a* can be moved past latch 8 when latch 8 is compressed into side 1*d*. Latch 8 holds horizontal piece 2*b* in its latched position which in turn holds separable section 2*a* in alignment with the fixed and covering sections of desk top 1*a*.

Also represented in FIG. 1 is a computer monitor 16 position to the right side of desk 1.

FIG. 2 shows desk 1 when equipment 10 is accessible. FIG. 2 shows a working surface 2 that is formed by folding out separable section 2*a* to an open position by way of a hinge 2*c*. Horizontal piece 2*b* and separable section 2*a* have been lowered past latch 8. A levelling mechanism, which is a parallelogram comprising a support piece 4, a levelling piece 3, horizontal piece 2*b*, a cross-brace 11, and levelling hinges 12, is used to keep surface 2 horizontal. Cross-brace 11 is part of the fixed structure of the desk and does not move with respect to the fixed section 1*e* of the desk top. An adjustable stop 5 on side 1*d* stops support piece 4 and therefore also surface 2 at an operating height determined by the setting of the adjustable stop. A tightening knob 13, mounted on a hanger bolt 13*a*, is used to set the position of stop 5 at any point between an uppermost position and a lowermost position. Horizontal piece 2*b* and separable section 2*a* can be returned to their latched positions without changing the position of stop 5, and, as long as stop 5 is not re-positioned, horizontal piece 2*b* and separable section 2*a* can later be returned to the same set operating height each time they are unlatched for use. FIG. 2 further shows covering section 1*b* in the covering position so that only a front face of computer equipment 10 is exposed.

FIG. 2*a* is an enlarged perspective view of the right front corner of desk 1. It shows side 1*d* containing a recess 1*g* and stop 5 mounted in recess 1*g* where recess 1*g* can accommodate stop 5 through its full range of adjustment. FIG. 2*a* shows the adjustable stop 5 set at a position between its uppermost and lowermost positions. Stop 5 comprises a protrusion 5*a*, a guide slot 5*b*, and an arc piece 5*c*. FIG. 2*a* shows the front part of stop 5 where protrusion 5*a*, the front part of arc piece 5*c*, and the front part of guide slot 5*b* are visible. It further shows that there is a gap between the right end of piece 3 and side 1*d*. Hanger bolt 13*a* (FIG. 2) and guide 15 (FIG. 2) are both attached to side 1*d* and pass through guide slot 5*b* such that stop 5 can be slide along the circular path determined by recess 1*g*, hanger bolt 13*a* and guide 15 when tightening knob 13 (FIG. 2) is loose. When tightening knob 13 is tight, stop 5 is pressed against side 1*d* and fixed in position. The protrusion 5*a* forms an "L" shape with arc piece 5*c* and therefore protrudes out from side 1*d* toward the center of the desk just far enough so that it will engage support piece 4 (FIG. 2) but not levelling piece 3. Support piece 4 is connected to horizontal piece 2*b* by one of the parallelogram hinges 12 (FIG. 2). Consequently, when horizontal piece 2*b* and separable section 2*a* are unlatched, they can be lowered until support piece 4 comes in contact with protrusion 5*a* which, as described above, determines the operating height of working surface 2.

Surface 2 is preferably shaped so that, when viewed from above the desk, it forms a convenient "L" shape with desk top 1*a*. Note specifically, operating edge 2*d* forms an obtuse angle with the central portion of a frontal edge 1*f* of desk top 1*a*. Strictly speaking, in plane geometry an angle cannot be formed by two edges that do not intersect and are not in the same plane. Also in plane geometry, lines and planes are unbounded and lines are projected perpendicularly onto a plane. Therefore it is more accurate to say that the projection of a line containing edge 2*d* onto a plane containing the top surface of desk top 1*a* forms an obtuse angle with frontal edge 1*f*. This angle is particularly advantageous in that it allows the operator, normally positioned near the central region of desk 1, to gain access to surface 2 by turning in his chair. Furthermore, even with full access to surface 2 and equipment 10, all of fixed section 1*e* and covering section 1*b* of desk top 1*a* is still available for traditional tasks. This is an important feature of the desk.

Thus, from the description made so far, it is already appreciated that desk 1 advantageously provides an uninterrupted desk top 1*a* for the performance of traditional desk functions, such as writing. Further, when separable section 2*a* is in the open position, desk 1 provides readily available access to computer equipment 10 while at the same time providing an ergonomic working surface 2. Even with separable section 2*a* in the open position, and with full access to equipment 10, almost all of the desk top 1*a* of desk 1 is still available for traditional desk tasks.

FIG. 3 shows an enlarged sectional view of FIG. 1 taken along the line A—A. Stop 5 is recessed into side 1*d* and therefore would normally not appear in this view but has been inserted to facilitate understanding. Stop 5 is shown in its uppermost position. Separable section 2*a*, shown in its closed position, is co-planar with covering section 1*b*, shown in its covering position. A latch 8 is directly under horizontal piece 2*b* and holds horizontal piece 2*b* and separable section 2*a* in their latched positions. FIG. 3 further shows cross-brace 11 hingedly connected to support piece 4 and levelling piece 3 by levelling hinges 12.

As can also be seen from FIG. 3, equipment 10 is located in compartment 1*c* underneath covering section 1*b* and resting on a computer shelf 6 which is adjustable in height by an adjustable support 7. Adjustable support 7 consists of dowels that fit snugly into holes which are arranged in vertical rows on the two sides of compartment 1*c*. Compartment 1*c* has enough space to adequately store a keyboard 9 (on support piece 4), equipment 10, and associated cabling. FIG. 3 also shows that, when covering section 1*b* and separable section 2*a* are in their covering and closed positions, compartment 1*c* is completely enclosed thereby preventing access to equipment 10.

FIG. 4 is a view of a portion of FIG. 3 showing stop 5 in its lowermost position. Other parts are shown in the same positions as in FIG. 3. Horizontal piece 2*b* and separable section 2*a* are held in their latched positions by latch 8.

FIG. 5 is a view of a portion of FIG. 3 showing separable section 2*a* in the open position after having been folded out around hinge 2*c* so that separable section 2*a* is in direct alignment with horizontal piece 2*b* and, thus, forming working surface 2. Latch 8 holds horizontal piece 2*a* and separable section 2*b* in their latched positions. Stop 5 is in its lowermost position.

FIG. 6 is a view of a portion of FIG. 3 showing surface 2 at its operating height and stop 5 at its lowermost position. Horizontal piece 2*a* and separable section 2*b* have been unlatched and therefore have rotated on levelling hinges 12 until support piece 4 has come in contact with protrusion 5*a* (FIG. 2) at the end of stop 5. The position of cross-brace 11 remains unchanged. As described above, stop 5 determines the operating height of surface 2. Surface 2 serves for the placement of keyboard 9 that is used in cooperation with equipment 10. Therefore, the setting of stop 5 can be used to place surface 2, and consequently keyboard 9, at a user selectable height. This allows the keyboard to be used comfortably by people of different dimensions. As also illustrated in FIG. 6, surface 2 is not only in close proximity to equipment 10, but also provides an ergonomic and comfortable under shelf leg-room clearance envelope to facilitate operation of keyboard 9.

A working surface 2 that not only is adjustable in height to user selectable levels but also provides adequate under shelf leg-room clearance is an important feature of the present invention in that use of a keyboard on such a shelf can considerably reduce the strain on an operator which might result in injury.

Thus, from what is described above, it becomes quite clear that an essential element of desk 1 is separable section 2*a* that performs a dual function of both forming working surface 2 that supports keyboard 9 when separable section 2*a* is in the open position, and preventing access to equipment 10 when separable section 2*a* is in the closed position. Also important is that working surface 2 is adjustable in height to accommodate operators of different dimensions and has the adequate under shelf leg-room clearance to increase comfort and reduce injury. Another important feature of desk 1 is that the simple action of moving separable section 2*a* from its closed to open position exposes the front of compartment 1*c* so that equipment 10 is accessible through desk top 1*a* while at the same time forming surface 2 for keyboard 9.

FIG. 7 is an enlarged perspective view similar to FIG. 2, but showing covering section 1*b* in a removed position. Separable section 2*a* is in the open position. This opens the entire top of compartment 1*c* so that equipment 10 and associated equipment and cabling can be easily removed or installed. However, as is best illustrated in FIG. 2, equipment and cabling can also be removed and installed with cover section 1*b* in the covering position in which case section 1*b* could remain permanently closed and be combined with section 1*e* to form a larger fixed section. FIG. 7 also shows keyboard 9 stored on support piece 4.

Referring now to FIG. 8 through 11 wherein desk 31 is a second embodiment of the invention. Except as described below, all parts with like names perform the same functions as in the first embodiment. FIG. 8 shows a perspective view of desk 31 which has a normal planer desk top 31*a* comprising fixed section 31*e*, covering section 31*b* and a separable section 44. Separable section 44, shown in the closed position, and covering section 31*b*, shown in a covering position, provide concealment for equipment 10 (not shown) and keyboard 9 (not shown) housed in equipment compartment 31*c* as in the first embodiment.

FIG. 9 is a top view of a portion of FIG. 8 showing the front right corner of desk 31. Separable section 44, comprising a tiltable component 44*a*, a horizontal component 44*b*, and a slope adjustment piece 44*c*, is shown in a closed position (marked in solid lines) and can be rotated by an angular adjustment hinge 44*d* from the closed position to an open position, as illustrated and marked in dashed lines. As in the preferred embodiment, when viewed from above, operating edge 32*d* forms an obtuse angle with frontal edge 31*f* of desk top 31*a* when separable section 44 is in the open position. In this embodiment, however, the angle between frontal edge 31*f* and operating edge 32*d* is adjustable.

FIG. 10 is an end view of separable section 44 taken along the line B—B. Non-essential parts have been omitted and tiltable component 44*a* is represented in its highest tilted position with respect to horizontal component 44*b*. Tiltable component 44*a* is rotatable about a slope adjustment hinge 44*e* and is held by slope adjustment piece 44*c*. This allows keyboard 9 to be used at an operator selectable slope.

FIG. 11 is a perspective view of desk 31 where separable section 44 is in the open position and tiltable component 44*a*, on which keyboard 9 (not shown) would be placed, is at the highest tilted position with respect to horizontal component 44*b*. Separable section 44 is connected to horizontal piece 32*b*, shown at an operating height, by angular adjustment hinge 44*d*. Other parts as adjustable stop 35, latch 38, support piece 34, levelling piece 33, levelling hinges 42 and tightening knob 43, perform the same functions as parts with like names in the first embodiment. Also, as in the first embodiment, covering section 31*b* can be placed in a removed position to allow full access to compartment 31*c* for installation and removal of equipment.

FIG. 11 shows clearly how separable section 44 provides a keyboard support that is adjustable in height, adjustable in slope, and has a variable angle with respect to the front of desk top 31*a*. It further shows that computer-office desk 31 provides readily available access to equipment 10 when separable section 44 is in the open position while still leaving most of desk top 31*a* available for traditional tasks.

Referring now to FIGS. 12–14 wherein desk 61 is a third embodiment of the invention and which, except as described below, has all the same parts as in the first embodiment, and where parts with like names perform like functions. FIG. 12 is a perspective view of a part of desk 61 showing an extension shelf 62*e* in a closed position with respect to separable section 62*a* shown in an open position. Horizontal piece 62*b*, hinge 62*c*, support piece 64, adjustable stop 65, and tightening knob 73 perform the same functions as their equivalent parts in the first embodiment. Covering section 61*b* is shown in its covering position, but as in the first embodiment, can be placed in a removed position to allow full access to equipment compartment 61*c* for installation and removal of equipment.

FIG. 13 is another perspective view of a part of desk 61 showing extension shelf 62*e* folded out with respect to separable section 62*a* by means of an extension hinge 62*f* to an open position to form working surface 62 with operating edge 62*d*. Separable section 62*a* and horizontal piece 62*b* are in their latched positions. This embodiment has a larger working surface 62 and an operating edge 62*d* that is more nearly perpendicular to frontal edge 61*f* of desk top 61*a* when compared to the first embodiment.

FIG. 14 is a perspective view of a part of desk 61 which shows surface 62 at an operating height where the height is determined by stop 65. Parts, as stop 65, latch 68, support piece 64, and levelling piece 63, perform the same functions as parts with like names in the first embodiment. It further shows that computer-office desk 61 provides readily available access to equipment 10 when separable section 62*a* is in the open position while still leaving a fixed section 61*e* and covering section 61*b* of desk top 61*a* available for traditional tasks.

Referring now to FIGS. 15 through 20 wherein desk 91 represents a fourth embodiment of the invention and where, except as described below, all parts with like names perform the same functions as in the first embodiment. FIG. 15 is a perspective view of desk 91 which shows desk top 91*a* comprised of fixed section 91*e*, covering section 91*b* in a covering position, and separable section 92*a* in a closed position. Hinges 92*c* are located at both front corners of separable section 92*a*. A front panel 106 is shown in a vertical position. As in other embodiments, when separable section 92*a* is in the closed position, the full desk top 91*a* is available for tradition tasks.

FIG. 16 shows desk 91 in perspective view with separable section 92*a* in an open position and an extension shelf 92*e* folded out by way of an extension hinge 92*f* to an open position to form working surface 92. Equipment 10 and keyboard 9 are now easily accessible. Keyboard 9, shown in its stored position on a fixed shelf 112, can be pulled forward onto surface 92 for use. Operating edge 92*d* of surface 92 faces toward the center of the desk and forms an obtuse but nearly right angle with frontal edge 91*f* of desk top 91*a*. As in previous embodiments, covering section 91*b* can be put to a removed position so that computer equipment or cabling can be changed.

FIG. 17 is a sectional view of desk 91 taken along line C—C of FIG. 15 showing that separable section 92*a*, covering section 91*b*, and front panel 106 enclose compartment 91*c* when in their closed, covering and vertical positions. Compartment 91*c* contains fixed shelf 112 which can be used to store keyboard 9 (not shown). Computer shelf 96 and adjustable support 97 perform the same functions as like parts in the first embodiment.

FIG. 18 through 20 are also sectional views of desk 91 taken along line C—C of FIG. 15 and show the interaction of separable section 92*a*, a connecting rod 108, a pivotal member 110, and front panel 106 as separable section 92*a* is moved from a closed to an open position. It is seen that separable section 92*a* moves in a clockwise manner from its closed position (FIG. 17) to its open position (FIG. 20) by passing through its partially opened positions (FIGS. 18–19). During such movement, front panel 106 and pivotal member 110 lead separable section 92*a* until all meet as shown in FIG. 20. FIG. 20 shows separable section 92*a* in alignment with fixed shelf 112 forming surface 92. Front panel 106 is shown in a horizontal position directly under and providing support for surface 92.

Referring now to FIGS. 21 through 24 wherein desk 21 represents a fifth embodiment of the invention and where, except as described below, all parts with like names perform the same functions as in the first embodiment. FIG. 21 is a perspective view of desk 21 which shows desk top 21*a* comprised of fixed section 21*e*, covering section 21*b* in a covering position, and separable section 22*a* in a closed position. Hinge 22*e* is located near the front edge of separable section 22*a* and hinge 22*f* near the front edge of horizontal piece 22*b*. A front panel 29 is shown in a vertical position and connects horizontal piece 22*b* to separable section 22*a*. As in other embodiments, when separable section 22*a* is in the closed position, the full desk top 21*a* is available for tradition tasks.

FIG. 22 shows desk 21 in perspective view where separable section 22*a* has been rotated about hinge 22*e* to an open position and front panel 29 has been rotated about hinge 22*f* to a horizontal position, thereby forming working surface 22. Covering section 21*b* is in its removed position. Equipment 10 and keyboard 9 are now easily accessible. Equipment 10 is supported by shelf 26. Keyboard 9, shown in its stored position, can be pulled forward onto surface 22 for use. Operating edge 22*d* of surface 22 faces toward the center of the desk and, when viewed from above, forms an obtuse angle with central part of a frontal edge 21*f* of desk top 21*a*.

FIG. 23 is a sectional view of desk 21 taken along line A—A of FIG. 21 showing separable section 22*a* in its closed position and front panel 29 in its vertical position. Nonessential parts have been omitted. Front Panel 29 is connected to separable section 22*a* by top hinge 22*e* and to horizontal piece 22*b* by bottom hinge 22*f*.

FIG. 24 is a sectional view of desk 21 taken along line B—B of FIG. 22 showing separable section 22*a* ins its open position and front panel 29 in its horizontal position. Nonessential parts have been omitted. Front Panel 29 is connected to separable section 22*a* by top hinge 22*e* and to horizontal piece 22*b* by bottom hinge 22*f*.

CONCLUSIONS, RAMIFICATIONS, AND SCOPE OF INVENTION

The reader will see that the computer-office desk of the invention provides the advantages of both a normal office desk and a computer desk. However, more importantly, this combination desk is much more useful than having two separate desks, one for traditional use and one for computer use, because many personal computers are used as tools to help with traditional activities. Therefore it is important to have a desk that can simultaneously support both uses in a single, integrated space. When computer equipment is not in use the entire desk top is at a comfortable height for writing and other traditional tasks. The single action of opening the separable section not only exposes the computer equipment for use, but also provides a lower level keyboard shelf. Because the separable section is only about 10% of the desk top, opening the separable section leaves 90% of the desk top at normal desk height so that almost all of the reference and writing materials already in use can remain undisturbed. Furthermore, the remaining 90% includes the most useful central portion of the desk top. Either surface is easily accessible to the user by a simple turning motion. In addition, both working surfaces have adequate under surface leg-room clearance for comfortable and healthy operation. The keyboard shelf can be adjustable in height to accommodate users of different dimensions.

The desk has additional advantages in that it provides an enclosed compartment for the storage of computer equipment which prevents access by unauthorized users, protects it from dust and dirt, and keeps cables from being damaged or disconnected;

it provides easy access to the full equipment compartment from the front of the desk when it is necessary to install or replace computer equipment or change cables.

Although the description above contains many specificities, these should not be construed as limiting the scope of the invention but as merely providing illustrations of some of the presently preferred embodiments of this invention. For example, the computer equipment can be situated at an angle under the desk top so that the controls at the front of the equipment face toward the front center of the desk. The shape of the separable section can be changed accordingly as can the design of the keyboard shelf levelling mechanism.

Thus the scope of the invention should be determined by the appended claims and their legal equivalents, rather than by the examples given.

I claim:

1. A computer-office desk for accommodating computer equipment, said computer-office desk comprising:

(a) a desk top having a fixed section and a separable section, said fixed section having a fixed section top surface and said separable section having a separable section top surface, said desk top having a frontal edge, said separable section having an open position and a closed position, said separable section being located along a part of said frontal edge of said desk top;

(b) at least one horizontal piece which is height adjustable, said horizontal piece having a latched position and an operating height such that in said latched position said separable section top surface and said fixed section top surface are co-planar and at said operating height said separable section top surface is in a plane parallel and not co-planar with said fixed section top surface;

(c) a hinge means interconnecting said horizontal piece and said separable section for allowing said separable section to be moved between said closed position and said open position such that in the open position said separable section provides a working surface, said working surface extending at least partially in front of said frontal edge of said desk top such that when viewed from above said desk top and said working surface form an approximate "L" shape;

(d) at least one fixed piece where said fixed piece does not move with respect to said fixed section;

(e) a levelling means connecting said horizontal piece to said fixed piece allowing said horizontal piece and said working surface to move from said latched position to said operating height while remaining horizontal whereby said working surface can be positioned to an operator selectable height to more comfortably accommodate operation of a keyboard.

2. The computer-office desk of claim 1 further comprising an equipment compartment located under said desk top and positioned so that when said separable section is in the open position said equipment compartment is accessible from above said desk top of said computer-office desk and when said separable section is in the closed position said equipment compartment is inaccessible.

3. The computer-office desk of claim 2 further comprising a positioning means for positioning said computer equipment within said equipment compartment of said computer-office desk, said positioning means being arranged to permit said computer equipment to be positioned so that related controls commonly requiring operator actions are easily accessible by an operator seated at said computer-office desk when said separable section is in the open position.

4. A computer-office desk according to claim 2 wherein said desk top further comprises a non-fixed covering section located above said equipment compartment, said covering section having a covering position and a removed position such that it covers said equipment compartment when in said covering position and provides access to said equipment compartment when in said removed position.

5. The computer-office desk of claim 1, wherein said levelling means comprises a levelling hinge means, a support piece, a levelling piece, and a cross brace where both said support piece and said levelling piece have a front edge and a back edge, where both said support piece and said levelling piece are connected at said back edge by said levelling hinge means to said cross brace and at said front edge by said levelling hinge means to said horizontal piece.

6. The computer-office desk of claim 5 wherein said support piece is used for storage of a keyboard.

7. The computer-office desk of claim 1, wherein said horizontal piece has a rear edge, such that said levelling means connects to said rear edge.

8. The computer-office desk of claim 1, further comprising an adjustable stop means for allowing said working surface to be repeatedly returned to a set operating height each time it is opened for use, said adjustable stop means being mounted on said computer-office desk.

9. The computer-office desk of claim 1, further comprising an extension shelf and an extension hinge means wherein said extension shelf is connected to said separable section by said extension hinge means, about which said extension shelf can be swung to form a planar extended working surface comprising said separable section in said open position and said extension shelf.

10. A computer-office desk for accommodating computer equipment, said computer-office desk comprising:

(a) a desk top further comprising a fixed section and a separable section, said desk top having a generally linear frontal edge and said separable section having an open position and a closed position, said separable section in said closed position being co-planar with and contiguous to said fixed section, said separable section having a frontal edge and said fixed section having a frontal edge where said fixed section frontal edge and said separable section frontal edge are contiguous segments of said desk top frontal edge when said separable section is in said closed position, said desk top having a horizontal perimeter where one side of said horizontal perimeter is said frontal edge;

(b) at least one horizontal piece;

(c) a hinge means interconnecting said horizontal piece and said separable section where said separable section can be rotated about said hinge means between said closed position and said open position, where said separable section, in said open position, is in a plane generally parallel with said fixed section, said separable section, in said open position, having an operating edge that at least partially extends horizontally beyond said desk top frontal edge and outside said horizontal perimeter such that when viewed from above, said operating edge of said separable section forms an obtuse to approximately right angle with said frontal edge of said fixed section therewith forming an approximate "L" shape with said fixed section whereby both said fixed section and said separable section can be easily accessed by an operator seated at said computer-office desk;

(d) an equipment compartment located under said desk top and positioned so that when said separable section is in the open position said equipment compartment is accessible from above said desk top of said computer-office desk and when said separable section is in the closed position said equipment compartment is inaccessible.

11. The computer-office desk of claim 10 further comprising a positioning means for positioning said computer equipment within said equipment compartment of said computer-office desk, said positioning means being arranged to permit said computer equipment to be positioned so that related controls commonly requiring operator actions are easily accessible by an operator seated at said computer-office desk when said separable section is in the open position.

12. The computer-office desk of claim 10, further comprising an extension shelf and an extension hinge means wherein said extension shelf is connected to said separable section by said extension hinge means, about which said extension shelf can be swung to form a planar extended working surface comprising said separable section in said open position and said extension shelf.

13. The computer-office desk according to claim 10 wherein said desk top further comprises a non-fixed covering section located above said equipment compartment, said covering section having a covering position and a removed position such that in said covering position said computer equipment in said equipment compartment is not removable and in said removed position said computer equipment in said equipment compartment is removable.

14. A computer-office desk for accommodating computer equipment, said computer-office desk comprising:

(a) a desk top having a fixed section and a separable section, said desk top lying in a desk top plane, said desk top having a generally linear frontal edge and said separable section having an open position and a closed position, said separable section in said closed position being co-planar with and contiguous to said fixed section, said separable section having a frontal edge and said fixed section having a frontal edge where said fixed section frontal edge and said separable section frontal edge are contiguous segments of said desk top frontal edge when said separable section is in said closed position;

(b) at least one horizontal piece;

(c) a hinge means interconnecting said horizontal piece and said separable section, said hinge means having a rotational axis that is parallel to said frontal edge, where said separable section can be rotated about said hinge means between said closed position and said open position such that in the open position said separable section provides a working surface, said working surface extending at least partially in front of said frontal edge of said desk top, said working surface being on a plane generally parallel to and below said fixed section, said working surface having an operating edge such that a line on said desk top plane which approximately coincides with a projection of said operating edge on said desk top plane forms an obtuse to generally right angle with said frontal edge of said desk top whereby both said desk top and said working surface can be easily accessed by an operator seated at said computer-office desk;

(d) an equipment compartment located under said desk top and positioned so that when said separable section is in the open position said equipment compartment is accessible from above said desk top of said computer-office desk and when said separable section is in the closed position said equipment compartment is inaccessible.

* * * * *